US008979246B2

(12) United States Patent
Sakai et al.

(10) Patent No.: US 8,979,246 B2
(45) Date of Patent: Mar. 17, 2015

(54) INKJET HEAD UNIT AND INKJET RECORDING DEVICE

(75) Inventors: Shigekazu Sakai, Tokyo (JP); Yoshifumi Takafuji, Kodaira (JP); Yuichi Machida, Hachoiji (JP); Naomi Kubo, Hino (JP); Koujiro Yoshida, Machida (JP); Yasuo Nishi, Hachioji (JP)

(73) Assignee: Konica Minolta, Inc. (JP)

( * ) Notice: Subject to any disclaimer, the term of this patent is extended or adjusted under 35 U.S.C. 154(b) by 0 days.

(21) Appl. No.: 13/996,795

(22) PCT Filed: Dec. 15, 2011

(86) PCT No.: PCT/JP2011/079070
§ 371 (c)(1),
(2), (4) Date: Jun. 21, 2013

(87) PCT Pub. No.: WO2012/086520
PCT Pub. Date: Jun. 28, 2012

(65) Prior Publication Data

US 2013/0271528 A1 Oct. 17, 2013

(30) Foreign Application Priority Data

Dec. 22, 2010 (JP) ..... 2010-286652

(51) Int. Cl.

| | |
|---|---|
| ***B41J 2/15*** | (2006.01) |
| ***B41J 2/145*** | (2006.01) |
| ***B41J 25/34*** | (2006.01) |
| ***B41J 2/155*** | (2006.01) |
| *B41J 25/00* | (2006.01) |

(52) U.S. Cl.
CPC *B41J 2/145* (2013.01); *B41J 25/34* (2013.01); *B41J 2/155* (2013.01); *B41J 2025/008* (2013.01); *B41J 2202/19* (2013.01); *B41J 2202/20* (2013.01)
USPC ..... 347/40

(58) Field of Classification Search
CPC ..... B41J 2/145; B41J 35/304; B41J 2/045; B41J 2/055; B41J 2/16; B41J 25/34
USPC ..... 347/40
See application file for complete search history.

(56) References Cited

U.S. PATENT DOCUMENTS

| | | | | |
|---|---|---|---|---|
| 4,611,219 | A * | 9/1986 | Sugitani et al. | 347/40 |
| 6,638,104 | B2 * | 10/2003 | Hashimoto et al. | 439/567 |
| 2011/0102504 | A1 * | 5/2011 | Wanibe | 347/37 |

FOREIGN PATENT DOCUMENTS

| | | | |
|---|---|---|---|
| JP | 2-47065 | A | 2/1990 |
| JP | 2000-289279 | A | 10/2000 |

(Continued)

OTHER PUBLICATIONS

International Search Report for International Application No. PCT/JP2011/079070, mailed Mar. 19, 2012, with English translation.

*Primary Examiner* — Alessandro Amari
*Assistant Examiner* — Michael Konczal
(74) *Attorney, Agent, or Firm* — Cantor Colburn LLP

(57) ABSTRACT

The object is to provide an inkjet head unit having: head chips having nozzles arranged on nozzle faces, and capable of discharging ink by respective independent pressure generating module from pressure chambers communicating with the nozzles; and a tabular head unit base on which the head chips are arranged and which is capable of holding the head chips, of abutting faces of the head unit base and the head chip, at least one of the abutting face on the head unit base side and the abutting face on the head chip side is formed in a stepped shape, so that the height of the abutting face of the head chip relative to the surface of the head unit base is partially changed, and the head chip is thereby attached to be inclined relative to the surface of the head unit base.

15 Claims, 14 Drawing Sheets

(56) References Cited

FOREIGN PATENT DOCUMENTS

| | | | |
|---|---|---|---|
| JP | 2002-307773 | A | 10/2002 |
| JP | 2006-327108 | A | 12/2006 |
| JP | 2009-220452 | A | 10/2009 |
| JP | 2010-58367 | A | 3/2010 |
| JP | 2010-105255 | A | 5/2010 |
| JP | 2011-93174 | A | 5/2011 |

* cited by examiner

Prior Art (a)

Prior Art (b)

INKJET HEAD UNIT AND INKJET RECORDING DEVICE

CROSS REFERENCE TO RELATED APPLICATIONS

This is the U.S. national stage of application No. PCT/JP2011/079070, filed on 15 Dec. 2011. Priority under 35 U.S.C. §119(a) and 35 U.S.C. §365(b) is claimed from Japanese Application No. 2010-286652, filed 22 Dec. 2011, the disclosure of which is also incorporated herein by reference.

TECHNICAL FIELD

The present invention relates to an inkjet head unit having a plurality of head chips arranged on a common head unit base and an inkjet recording device comprising this.

BACKGROUND

In an inkjet head that jets out droplets from a nozzle and performs recording, when a nozzle column is lengthened in order to obtain a desired recording width, since obtaining jetting characteristics uniform in the width direction is very difficult, many head chips with a small width that are individually manufactured are used and arranged on a common head unit base in a zigzag pattern, thereby fabricating an inkjet head unit in which nozzles are aligned over a desired recording width as a whole (Patent Literatures 1 and 2).

Each of FIGS. 17(*a*) and (*b*) shows a conventional inkjet head unit 100 having four head chips arranged on a head unit base in a zigzag pattern so that they can form two columns. (*a*) is a side elevation showing a cross section of the head unit base, and (*b*) is a plan view showing the same from the opposite side of a nozzle face.

Head chips 200 are inserted into four attachment opening portions 301 formed in a common head unit base 300 made of a material such as SUS into a tabular shape from respective nozzle face 201 sides, and attachment flange portions 202 formed so as to protrude in a lateral direction from the respective head chips 200 abut on and are fixed to upper surface sides of side edge portions of the attachment opening portions 301, whereby the head chips 200 are arranged on the head unit base 300 in a planar manner.

Many nozzles, which correspond to, e.g., 1200 npi (nozzle per inch), are arranged on the nozzle face 201 of each head chip 200 in an array shape, and the respective head chips 200 are positioned on the head unit base 300 in such a manner that pitches of the nozzles can be an equal pitch along a Y direction in the drawing across all the head chips 200 as seen in a direction parallel to an X direction in the drawing.

It is to be noted that, in the drawing, reference numeral 203 denotes an ink manifold, and reference numeral 204 designates an external wiring member (FPC). The external wiring member 204 is connected to a surface of each attachment flange portion 202 on the opposite side of the head unit base 300.

Further, as shown in FIG. 18, each head chip 200 may be also inserted into each attachment opening portion 301 in the head unit base 300 from the ink manifold 203 side, and each attachment flange portion 202 may abut on and may be fixed to a lower surface side of the side edge portion of each attachment opening portion 301 so that each head chip 200 can be arranged on the head unit base 300 in a planar manner. In the conformation shown in FIG. 17, since each nozzle face 201 and the head unit base 300 are arranged on the same side with respect to each attachment flange portion 202 of each head chip 200, the head unit base 300 must be thinly formed in order to arrange each nozzle face 201 as close to a recording receiving surface of a recording medium (not shown) wound around and held on a drum surface 401 as possible, and there is a problem of a reduction in strength, but the nozzle face 201 of each head chip 200 and the head unit base 300 are arranged on the opposite sides so as to sandwich the attachment flange portion 202 therebetween in this conformation, and hence a thickness of the head unit base 300 can be increased and sufficient strength can be assured.

Each external wiring member 204 is placed between each attachment flange portion 202 and the head unit base 300, and the external wiring member 204 placed on the inner side is pulled out to the opposite face of the nozzle face 201 through a wiring extraction hole 302 formed in the head unit base 300.

In case of using such an inkjet head unit 100 as shown in FIG. 17 and FIG. 18 and installing it in a high-speed drum conveyer having a cylindrical rotary drum 400 to perform drawing, the inkjet head unit 100 is arranged in such a manner that its X direction in the drawing becomes parallel to a rotating direction (a circumferential direction) of the rotary drum 400. At this time, since each nozzle face 201 and the head unit base 300 have flat surfaces parallel to each other whereas the drum surface 401 of the rotary drum 400 has a curved surface, each head chip 200 has a large difference between a distance D1 from a nozzle placed on the central side of the head unit base 300 to a curved recording receiving surface (a surface) of a recording medium (not shown) wound around and held on the drum surface 401 and a distance D2 from a nozzle placed on each of both end portion sides of the head unit base 200 along the circumferential direction of the drum 400 to the curved recording receiving surface of the recording medium wound around and held on the drum surface 401 in a relationship of D1<D2, and a time required until impact of ink droplets which are to strike on the recording receiving surface of the recording medium greatly differs depending on positions of the nozzles along the rotating direction of the rotary drum 400.

Such a time lag until the impact depending on each nozzle position can be solved by finely adjusting timing for jetting out an ink from the nozzles. However, since a height position of the head unit base 300 with respect to the recording receiving surface of the recording medium on the drum surface 401 is set in such a manner that a distance between the nozzle face 201 and the recording receiving surface of the recording medium on the drum surface 401 becomes a proper distance (approximately 1 mm) which is the shortest distance D1, when the distance D2 is the longest as compared with the proper distance D1, travel of the ink droplets over this long distance D2 results in the following another problem.

FIG. 19 is a graph showing a relationship between a gap amount (a distance between the nozzle face and the recording receiving surface of the recording medium) and an impact accuracy. The measurement was carried out by keeping both the nozzle face and the recording receiving surface immovable, determining a point where a straight line vertically downwardly extended from a specific nozzle crosses the recording receiving surface as a proper impact point, and using a contactless three-dimensional measuring instrument to measure an impact position coordinate with respect to the proper impact position when a distance between the nozzle face and the recording receiving surface is increased.

As a result, it can be understood that the impact accuracy is deteriorated (an impact error increases) as the gap amount is increased. That is because, when the distance between each nozzle and the recording receiving surface increases and the traveling distance of the ink droplets gets longer, an airflow (e.g., an airflow generated by rotation of the rotary drum 400) is apt to affect, and a traveling direction is disarrayed.

Therefore, there is a problem that the ink droplets that travel the distance D2 are more affected by an airflow than the ink droplets that travel the distance D1 and an impact position deviation occurs. Such an impact position deviation caused due to an airflow cannot be adjusted by jetting timing, and it can be a cause that deteriorates image quality.

Patent Literature 3 conventionally discloses that a nozzle plate is formed into a curved surface that is bent to form part of a cylindrical shape. When the nozzle plate is curved, a distance between a surface of a cylindrical rotary drum and each nozzle can be substantially fixed, but precisely bending the nozzle plate so that it can fit to the surface of the rotary drum is very difficult, and there arises a problem of a difficulty in manufacture.

Further, a method for bending a head unit base itself in accordance with a curved shape of a rotary drum surface can be also considered, but there is also a problem that precisely bending the head unit base so as to fit to the rotary drum surface is difficult.

Furthermore, Patent Literature 4 discloses that a piezoelectric actuator is used and an inclination of a head chip with respect to a recording medium is adjusted. However, providing the piezoelectric actuator for adjustment of the inclination of each head chip leads to a problem that a configuration of an inkjet head unit is complicated, manufacture becomes difficult, and also a manufacturing cost increases.

PRIOR ART DOCUMENTS

Patent Documents

Patent Document 1: JP-A-2010-58367
Patent Document 2: JP-A-2010-105255
Patent Document 3: JP-A-2006-327108
Patent Document 4: JP-A-2009-220452

SUMMARY OF THE INVENTION

Problem to be Solved by the Invention

In view of the above-described problem, it is an object of the present invention to provide an inkjet head unit that enables reducing a difference between distances of respective nozzles from a curved heating surface without curving a nozzle plate or a head unit base and also provide an inkjet recording device using this.

Other objects of the present invention will become evident from the following description.

Means for Solving Problem

The above object is solved by each of the following inventions.

1. An inkjet head unit comprising: a plurality of head chips which has a plurality of nozzles arranged on a nozzle face and is capable of discharging an ink by respective independent pressure generation module from pressure chambers communicating with plurality of nozzles, respectively; and a tabular head unit base which is capable of arranging and holding the plurality of head chips, wherein, of abutting faces on which the head unit base and the head chip abut, at least any one of the abutting face on the head unit base side and the abutting face on the head chip side is formed into a stepped shape, a height of the abutting face of the head chip relative to a surface of the head unit base is partially changed, and hence the head chip is disposed to be inclined to the surface of the head unit base.

2. The inkjet head unit according to 1, wherein the head unit base has an attachment opening portion for the head chip, and the head chip has an attachment flange portions that protrude to opposed lateral sides and is disposed to the head unit base when the respective attachment flange portions abut on opposed side edge portions of the attachment opening portion, at least any one of abutting surfaces of the attachment flange portions and the side edge portions is formed into a stepped shape, and a height of the abutting face of the head chip relative to the surface of the head unit is partially changed.

3. The inkjet head unit according to 2, wherein any one of the side edge portions of the attachment opening portion in the head unit base is concaved into a stepped shape with a predetermined depth from an surface side of the head unit base opposite to an ink discharging direction, and the head chip is disposed to be inclined relative to the surface of the head unit base when the respective attachment flange portions abut on the head unit base from the surface side of the head unit base opposite to the ink discharging direction and one attachment flange portion abuts on the side edge portion concaved into the stepped shape.

4. The inkjet head unit according to 2, wherein any one of the side edge portions of the attachment opening portion in the head unit base is concaved into a stepped shape with a predetermined depth from an surface side of the head unit base in an ink discharging direction, and the head chip is disposed to be inclined relative to the surface of the head unit base when the respective attachment flange portions abut on the head unit base from the surface side of the head unit base in the ink discharging direction and one attachment flange portion abuts on the side edge portion concaved into the stepped shape.

5. The inkjet head unit according to 2, wherein any one of the side edge portions of the attachment opening portion in the head unit base is concaved into a stepped shape with a predetermined depth from an surface side of the head unit base in an ink discharging direction, and the other side edge portion is concaved into a stepped shape with a predetermined depth from the surface side of the head unit base opposite to the ink discharging direction, and the head chip is disposed to be inclined relative to the surface of the head unit base when one attachment flange portion abuts on the head unit base from the surface side of the head unit base in the ink discharging direction and also abuts on the side edge portion concaved into the stepped shape with the predetermined depth from the surface side of the head unit base in the ink discharging direction and the other attachment flange portion abuts on the head unit base from the surface side of the head unit base opposite to the ink discharging direction and also abuts on the side edge portion concaved into the stepped shape with the predetermined depth from the surface side of the head unit base opposite to the ink discharging direction.

6. The inkjet head unit according to 4 or 5, wherein an external wiring member is connected to each of the attachment flange portions of the head chip, and a wiring extraction hole is pierced and formed near the side edge portion concaved from the surface side of the head unit base in the ink discharging direction, and the external wiring member connected to the attachment flange portion abutting on the side edge portion is drawn to the surface of the head unit base opposite to the ink discharging direction through the wiring extraction hole.

7. The inkjet head unit according to any one of 3 to 6, wherein a material of the head unit base is glass, and the head unit base is concaved into the stepped shape with a predetermined depth by blasting.

8. The inkjet head unit according to any one of 3 to 6, wherein a material of the head unit base is Si, and the head unit base is concaved into the stepped shape with a predetermined depth by etching.

9. The inkjet head unit according to any one of 3 to 6, wherein a material of the head unit base is SUS, and the head unit base is concaved into the stepped shape with a predetermined depth by at least one of milling, blasting, and etching.

10. The inkjet head unit according to 1, wherein the head unit has an attachment opening portion for the head chip, and the head chip is formed of a plurality of layers, the plurality of layers have different widths so that different layers in the plurality of layers abut on opposed side edge portions of the attachment opening portion, and abutting faces relative to the side edge portions are thereby formed.

11. The inkjet head unit according to any one of 1 to 10, wherein the head chip is bonded to the head unit base by a photosensitive adhesive.

12. The inkjet head unit according to any one of 1 to 11, wherein the head chip comprises a plurality of nozzle columns that are aligned along an inclining direction of the head chip.

13. An inkjet recording device comprising:

a rotary drum which is rotatable while holding a recording medium on a curved surface thereof; and an inkjet head unit according to any one of 1 to 12 which has the plurality of head chips arranged along a circumferential direction of the rotary drum, is arranged in such a manner that the respective nozzle faces of the head chips are placed near a recording receiving surface of the recording medium held on the surface of the rotary drum, and performs drawing by discharging an ink from the nozzles toward the recording receiving surface of the recording medium, wherein a line of each of the plurality of head chips, which are arranged in the circumferential direction of the rotary drum, vertical to the center of each nozzle face runs through a rotation center of the rotary drum.

Effect of the Invention

According to the inkjet head unit and the inkjet recording device according to the present invention, a difference between distances of the respective nozzles from the curved recording receiving surface without curving the nozzle plate or the head unit base.

DESCRIPTION OF THE PREFERRED EMBODIMENTS

Figure 1:
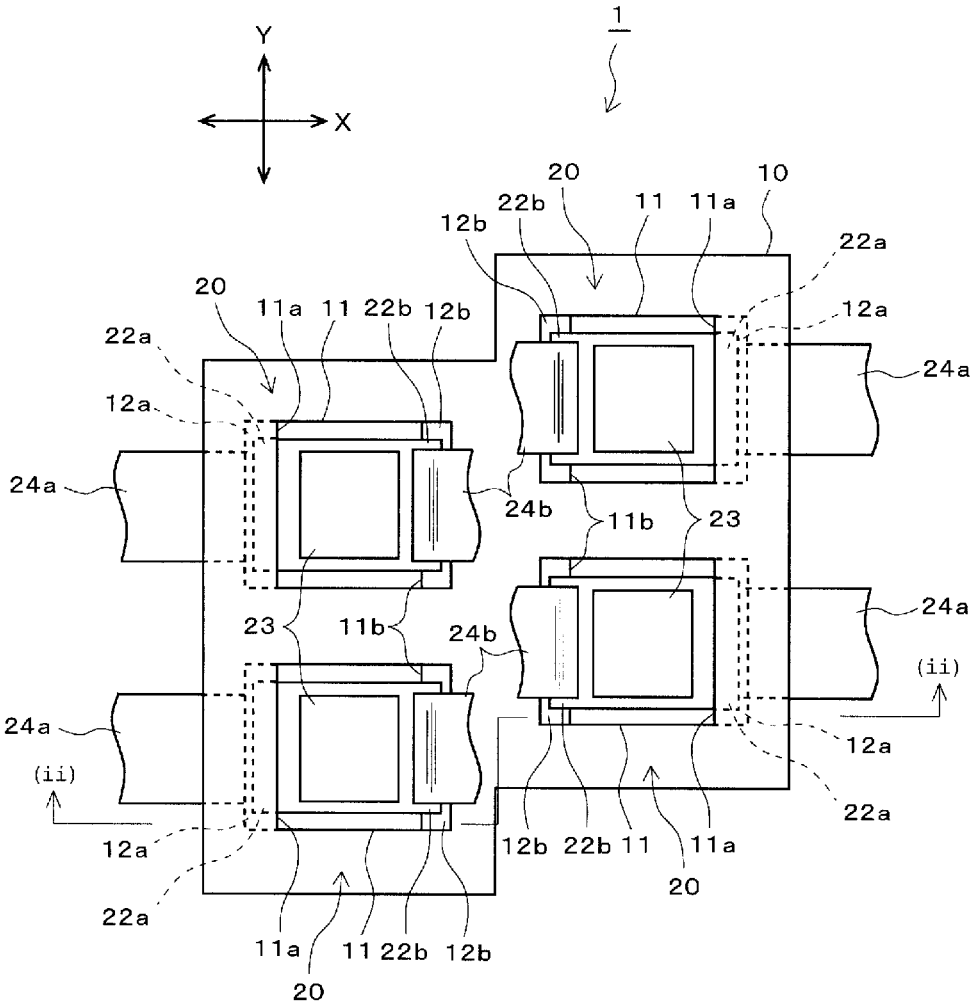
FIG. 1 is a view showing an example of an inkjet head unit according to the present invention and it is also a plan view seen from a surface of a head chip on the opposite side of a nozzle face.

An inkjet head unit according to the present invention comprises: head chips each of which has a plurality of nozzles arranged on a nozzle face thereof and can discharge an ink from pressure chambers communicating with each of the plurality of nozzles by respective independent pressure generating means; and a tabular head unit base that has the plurality of head chips arranged thereon and can hold them. Of abutting faces on which the head unit base and the head chips abut when each of the plurality of head chips are arranged and held on the head unit base, at least one of an abutting face on the head unit base side and an abutting face on the head chips side is formed into a stepped shape so that a height of the abutting face of the head chip with respect to the surface of the head unit base is partially changed, and the head chip is attached to be inclined relative to the surface of the head unit base.

Here, the stepped shape corresponds to a state that a thickness of a region constituting the abutting face is smaller or larger than a thickness of any other region, and it is a shape that the abutting face has a surface parallel to a surface of any other region.

In this manner, when the abutting face of the head unit base and the head chip is formed into the stepped shape and the height of the abutting face of the head chip relative to the surface of the head unit base is partially changed, the head chip has a nozzle face inclined with respect to the surface of the head unit base. An inclination angle of the head chip can be easily adjusted by adjusting thinness (a thickness) at the time of forming the abutting face into the stepped shape.

When the head unit base is formed with attachment opening portions for the head chips, each head chip can be disposed so as to be partially inserted into this attachment opening portion. At this time, the head chip has an attachment flange portion that protrudes toward opposite lateral sides, and it is disposed to the head unit base when the attachment flange portion abuts on opposed side edge portion of the attachment opening portion of the head unit base.

Therefore, in this case, since opposed surfaces of the side edge portion of each attachment opening portion of the head unit base and the attachment flange portion of the head chip are abutting faces, at least one of the side edge portion and the attachment flange portion, which is one of the two opposed side edge portions in case of the side edge portions, is formed into a stepped shape, and one of the two attachment flange portions protruding in opposite directions in the attachment flange portions is formed into a stepped shape, a height of the abutting face of the head chip relative to the head unit base can be thereby changed when the side edge portions and the attachment flange portions abut on each other, and the head chip can be disposed so as to be inclined with respect to the surface of the head unit base.

In the present invention, as a material of the head unit base, glass can be adopted. In this case, the abutting surface of the head unit base with respect to the head chip can be formed into the stepped shape by concaving the surface in a stepped pattern with a predetermined depth by blasting. A stepped concave portion with a desired depth can be highly accurately and easily formed by blasting with respect to a glass substrate.

Further, as the material of the head unit base, Si (silicon) can be used. In this case, the abutting face of the head unit base with respect to the head chip can be formed into the stepped shape by concaving Si from the surface with a predetermined depth based on etching. As the etching, a RIE (Reactive Ion Etching) method can be preferably used. A stepped concave portion with a desired depth can be highly accurately and easily formed by the etching.

Moreover, as the material of the head unit base, SUS (stainless) can be also used. In this case, the abutting face of the head unit base with respect to the head chip can be formed into the stepped shape by concaving the SUS into the stepped shape with a predetermined depth from the surface based on at least one of milling, blasting, and etching. When one of the above-described types of processing is performed with respect to an SUS substrate, a stepped concave portion can be highly accurately easily formed with a desired depth.

As a conformation that each head chip is inclined with respect to the surface of the head unit base, there are a conformation that the head unit base side alone is formed into the stepped shape, a conformation that the head chip side alone is formed into the stepped shape, and a conformation that both the head unit base and the head chip are formed into the stepped shapes but, when the trouble of processing is taken into consideration, the conformation that one of the head unit base and the head chip is formed into the stepped shape is preferable. In particular, forming the head unit base alone into the stepped shape is preferable since one tabular substrate can be easily processed.

Although the head unit base can abut on the head chip by utilizing the attachment flange portions formed to protrude from the head chip toward the lateral sides and arranging the attachment flange portions to abut on the side edge portions of the attachment opening portion of the head unit base, the head unit base can also abut on the head chip by utilizing a head chip main body portion of the head chip and arranging this main body portion to abut on the side edge portions of the attachment opening portion of the head unit base.

In the inkjet recording device according to the present invention, this inkjet head unit is used, and a nozzle face thereof is arranged to face a recording receiving surface of a recording medium. The inkjet recording device has a rotary drum that holds a recording medium on a curved surface and can rotate, and one or more inkjet head units are arranged with respect to the recording receiving surface of the recording medium held on the surface of this rotary drum. In each inkjet head unit, a plurality of head chips are arranged along a circumferential direction of the rotary drum, and respective nozzle faces of the plurality of head chips are arranged near the recording receiving surface of the recording medium held on the surface of the rotary drum.

The plurality of head chips arranged in the circumferential direction of the rotary drum are disposed in such a manner that a perpendicular for the center of each nozzle face coincides with the rotation center of the rotary drum.

Therefore, the center of each nozzle face is the closest to the curved recording receiving surface of the recording medium held on the curved surface of the rotary drum and the nozzle face is separated from the recording receiving surface of the recording medium as distanced from this center along a rotating direction of the rotary drum and a direction parallel to an opposite direction of the rotating direction, but this separation distance becomes minimum, and a difference between separation distances from the respective nozzles within the nozzle face to the recording receiving surface of the recording medium can be reduced. Therefore, deviations of impact positions of the respective nozzles can be suppressed.

A specific embodiment according to the present invention will now be described with reference to the drawings.

Figure 2:
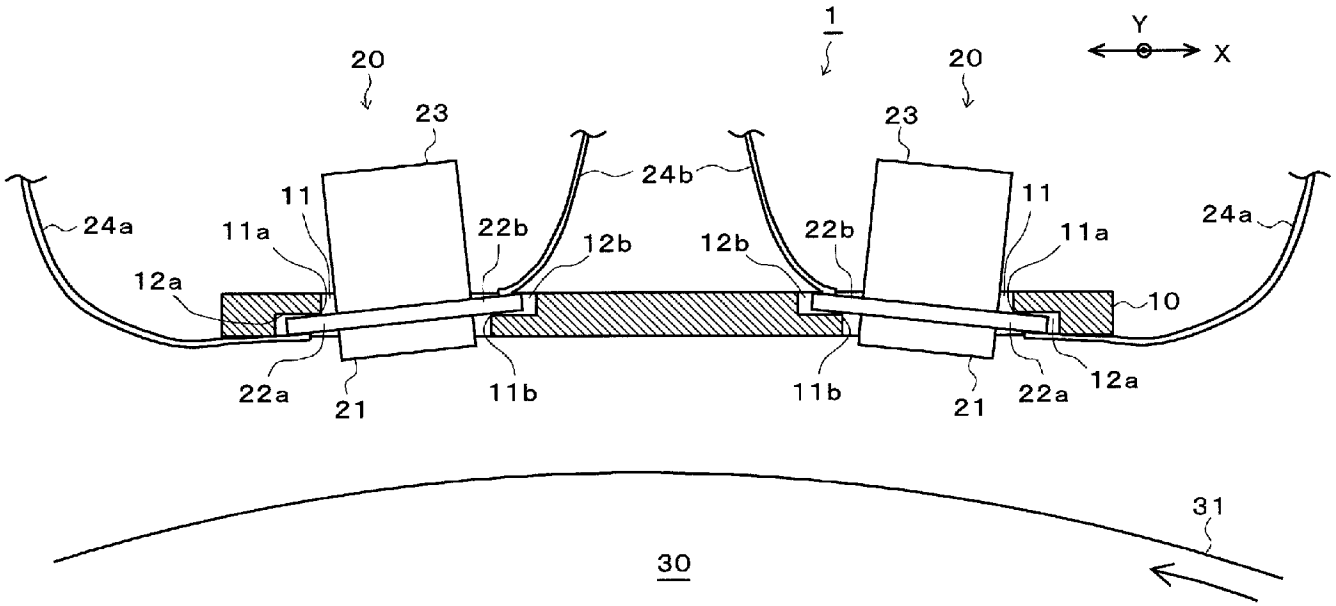
FIG. 2 is a view showing a state that the inkjet head unit depicted in FIG. 1 is arranged near a surface of a rotary drum.
Figure 3:
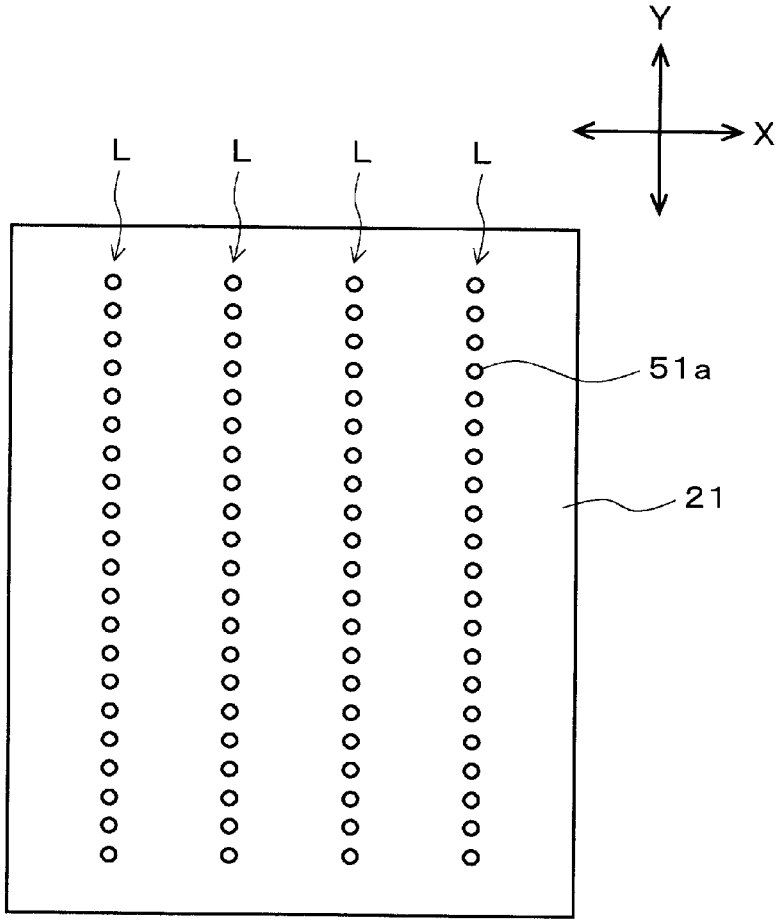
FIG. 3 is a view showing a nozzle face of a head chip.

FIG. 1 is a view showing an example of an inkjet head unit according to the present invention, and it is a plan view as seen from the opposite side of a nozzle face of a head chip. FIG. 2 is a view showing a state that the inkjet head unit depicted in FIG. 1 is arranged near a recording receiving surface of a recording medium (not shown) held on a surface of a rotary drum, where the inkjet head unit is shown in a cross-sectional view taken along a line (ii)-(ii) in FIG. 1. FIG. 3 is a view showing the nozzle face of the head chip.

In an inkjet head unit 1, four head chips 20 are arranged on one tabular head unit base 10 in a zigzag pattern along a Y direction in the drawing so that these chips can be aligned in two columns in an X direction in the drawing. The head unit base 10 is formed of a glass substrate in this embodiment, and attachment opening portions 11 each having a rectangular shape as seen in a planar view are pierced in attachment positions of the respective head chips 20. In case of using an Si substrate or an SUS substrate as the head unit base 10, the same configuration as this embodiment described below can be adopted. It is to be noted that the X direction and the Y direction in the drawing are orthogonal to each other.

As shown in FIG. 3, many nozzles 51*a* are arranged in a nozzle face 21 of each head chip 20 in an array form, and nozzle columns L are configured by aligning many nozzles 51A in the Y direction in the drawing. The plurality of nozzle columns L are aligned in parallel along the X direction in the drawing. In the inkjet head unit 1, as seen from the X direction in FIG. 1, the respective head chips 20 are positioned and held in the respective attachment opening portions 11 of the head unit base 10 so that pitches of the nozzles 51*a* can be equal along the Y direction in the drawing in all the head chips 20.

Two attachment flange portions 22*a* and 22*b* that greatly protrude to both lateral sides along the X direction in the drawing are formed to each head chip 20. One attachment flange portion 22*a* is placed on the outer side at the time of attachment to the head unit base 10, and the other attachment flange portion 22*b* is placed on the inner side at the time of attachment to the head unit base 10. The nozzle face 21 protrudes to an ink discharge direction from positions of these attachment flange portions 22*a* and 22*b*, and an ink manifold 23 in which an ink is stored is provided on the opposite side of the nozzle face 21 to interpose the attachment flange portions 22*a* and 22*b* therebetween.

The attachment opening portion 11 of the head unit base 10 has a width in the X direction in the drawing that is smaller than a width of the two attachment flange portions 22*a* and 22*b* in a protruding direction, and it also has a width in the Y direction in the drawing that is larger than the head chip 20. Therefore, the head unit base 10 and the head chip 20 abut on each other at the two attachment flange portions 22*a* and 22*b*.

An example of a configuration of the head chip will now be described with reference to a cross-sectional view depicted in FIG. 4.

In the head chip 20, a head chip main body 50 and a wiring substrate layer 60 are laminated and integrated. Here, the wiring substrate layer 60 protrudes toward the lateral sides beyond the head chip main body 50 so that the attachment flange portion 22 is formed, and the ink manifold 23 is provided on an upper surface of this wiring substrate layer 60.

The head chip main body 50 has a nozzle plate layer 51 formed of an Si (silicon) substrate, an intermediate plate layer 52 formed of a glass substrate, a pressure chamber plate layer 53 formed of an Si (silicon) substrate, and a vibrating plate 54 formed of an $SiO_2$ thin film. Many nozzles 51*a* are opened and aligned in a lower surface of the nozzle plate layer 51.

In the pressure chamber plate layer 53, pressure chambers 53*a* that store an ink to be discharged are formed, and an upper wall of each of these chambers is formed of the vibrating plate 54, and a lower wall of the same is formed of the intermediate plate layer 52. Communication paths 52*a* that enable the inside of the pressure chambers 53*a* to communicate with the nozzles 51*a* are pierced and formed in the intermediate plate layer 52.

Actuators 55 as pressure generating means formed of a thin film PZT are individually laminated on an upper surface of the vibrating plate 54 to be associated with the pressure chambers 53 in an one-on-one relationship. Reference numeral 55*a* denotes an upper electrode configured to feed electric power to each actuator 55, and it is laminated on an upper surface of each actuator 55. Furthermore, reference numeral 55*b* designates a lower electrode, and it is laminated between an upper surface of the vibrating plate 54 and a lower surface of each actuator 55 in common. Therefore, each actuator 55 is sandwiched between the upper electrode 55*a* and the lower electrode 55*b*, and it is mechanically deformed when a predetermined voltage is applied between the upper electrode 55*a* and the lower electrode 55*b*, and the vibrating plate 54 is vibrated.

The wiring substrate layer 60 has a substrate main body 61 formed of an Si substrate and an adhesive resin layer 62, and it is laminated in such a manner that a gap corresponding to a thickness of the adhesive resin layer 62 is provided between the head chip main body 50 and the substrate main body 61 and a predetermined space is formed between the substrate main body 61 and the vibrating plate 54 in a region of each actuator 55.

Vertically penetrating through holes 63 are formed in this wiring substrate layer 60, one end (an upper end) of each of these holes communicates with the inside of the ink manifold 23, the other end (a lower end) of the same communicates with the inside of each pressure chamber 53*a* in the head chip main body 50, and the ink in the ink manifold 23 can be allowed to flow and supplied into each pressure chamber 53*a*.

A non-illustrated external wiring member (FPC) is ACF-connected to each end portion of the wiring substrate layer 60 that serves as each attachment flange portion 22, each actuator 55 is deformed and the vibrating plate 54 is vibrated by feeding electric power to the upper electrode 55*a* and the lower electrode 55*b* laminated on each actuator 55 through wiring lines formed on the wiring substrate layer 60, a pressure for discharge is thereby applied to the ink in each pressure chamber 53*a*, and the ink is discharged as small droplets from each nozzle 51*a* through the communication path 52*a*.

In the head unit base 10 to which each head chip 20 having the above-described configuration is disposed, as shown in FIG. 2, surfaces of the periphery of each attachment opening portion 11 that abut on the two attachment flange portions 22*a* and 22*b* of the each chip 20 are formed into a stepped shape by forming concave portions 12*a* and 12*b* each having a predetermined depth.

The concave portion 12*a* that functions as an abutting face with respect to one attachment flange portion 22*a* is formed by graving a side edge portion 11*a* placed on the outer side of each attachment opening portion 11 along the X direction in the drawing from the surface side (a lower surface side in FIG. 2) of the head unit base 10 opposite to an ink discharging direction with a predetermined depth. As a result, the side edge portion 11*a* partially has a small thickness.

The concave portion 12*b* that functions as an abutting face with respect to the other attachment flange portion 22*b* is formed by graving a side edge portion 11*b* placed on the inner side of each attachment opening portion 11 along the X direction in the drawing from the surface side (an upper surface side in FIG. 2) of the head unit base 10 opposite to the ink discharging direction with a predetermined depth. As a result, the side edge portion 11*b* partially has a small thickness.

As a result, the side edge portions 11*a* and 11*b* of the attachment opening portion 11 of the head unit base 10 that face each other along the X direction in the drawing have the concave portions 12*a* and 12*b* alternately on front and back sides of the head unit base 10 so that each side edge portion is formed into the stepped shape.

It is to be noted that the side edge portions 11*a* and 11*b* mean two side edge portions on which the attachment flange portions 22*a* and 22*b* that protrude toward both the lateral sides of the head chip 20 abut on the inner peripheral edge of the rectangular attachment opening portion 11, respectively. When the thicknesses of these side edge portions 11*a* and 11*b* are reduced, the attachment flange portions 22*a* and 22*b* sag in a thickness direction of the head unit base 10 below the surface of the head unit base 10 at the time of arranging the attachment flange portions 22*a* and 22*b* to abut in order to dispose the head chip 20 since the thicknesses are reduced, and the attachment flange portions 22*a* and 22*b* are allowed to abut on positions lower than a height position of the surface of the head unit base 10.

In the head chip 20, one attachment flange portion 22*a* associated with one side edge portion 11*a* of the attachment opening portion 11 is arranged in such a manner that it abuts on the side edge portion 11*a* from the lower surface side of the head unit base 10 and an end portion of the attachment flange portion 22*a* is accommodated in the concave portion 12*a*. Moreover, the other attachment flange portion 22*b* associated with the other side edge portion 11*b* of the attachment opening portion 11 is arranged in such a manner that it abuts on the side edge portion 11*b* from the upper surface side of the head unit base 10 and an end portion of the attachment flange portion 22*b* is accommodated in the concave portion 12*b*.

As a result, the nozzle face 21 of each head chip 20 is disposed to be inclined with respect to the surface of the head unit base 10 along the X direction in the drawing. An inclination angle of the head chip 20 is finely adjusted by finely adjusting a concave depth of each of the concave portions 12*a* and 12*b* and an overlapping amount of each of the side edge portions 11*a* and 11*b* of the attachment opening portion 11 and each of the attachment flange portions 22*a* and 22*b* of the head chip 20.

A photosensitive adhesive (not shown) is applied to the respective attachment flange portions 22*a* and 22*b* of each head chip 20, and it is cured and fixed when light having a wavelength corresponding to curing sensitivity of the adhesive is applied thereto. When the photosensitive adhesive is used as fixing means, in a state before applying the light even after the application of the adhesive, a position of the head chip in the attachment opening portion 11 can be finely adjusted. As the photosensitive adhesive, an ultraviolet curable adhesive that is cured when UV light is applied thereto can be preferably used.

Additionally, in case of using the ultraviolet curable adhesive, it is preferable for the head unit base 10 to be formed of a glass substrate. To fix the attachment flange portions 22*a* and 22*b* of the head chip 20 to the head unit base 10, the head unit base 10 is first appressed against the ultraviolet curable adhesive applied to the attachment flange portions 22*a* and 22*b*, and the head chip 20 is set to an optimum position. Then, when the head unit base 10 is irradiated with ultraviolet rays from an ultraviolet irradiation device (not shown), the ultraviolet rays transmitted through the head unit base 10 are applied to the ultraviolet curable adhesive, the ultraviolet curable adhesive is cured, and the head chip 20 is bonded and fixed to the head unit base 10.

As described, in case of bonding and fixing the attachment flange portions 22*a* and 22*b* of the head chip 20 to the head unit base 10 by using the ultrasonic curable adhesive, when a glass substrate having a high ultraviolet transmittance is used for the head unit base 10, the ultraviolet curable adhesive is substantially homogeneously cured, the ultraviolet curable adhesive is irradiated with the ultraviolet rays in a contactless manner, and hence the head chip 20 is fixed to the head unit base 10 without displacing the head chip 20 set to the optimum position. That is, the position of the head chip unit 20 in the attachment opening portion 11 of the head unit base 10 is bonded and fixed in the optimum state, and the highly accurately positioned inkjet head unit can be easily stably supplied.

External wiring members 24*a* and 24*b* configured to feed electric power to the upper electrode 55*a* and the lower electrode 55*b* (FIG. 4) of each actuator 55 are connected to the respective attachment flange portions 22*a* and 22*b* of the head chip 20. One external wiring member 24*b* is connected to the lower surface side (the nozzle face 21 side) of the attachment flange portion 22*a* that is a lower side in an inclining direction relative to the surface of the head unit base 10, whilst the other external wiring member 24*b* is connected to the upper surface side (the ink manifold 23 side) of the attachment flange portion 22*b* that is an upper side of the inclining direction relative to the surface of the head unit base 10, and these external wiring members 24*a* and 24*b* are drawn to the upper side and electrically connected to a non-illustrated drive IC.

In FIG. 2, reference numeral 30 designates a cylindrical rotary drum constituting an inkjet recording device, and a recording medium (not shown) is held on a curved drum surface 31 to constitute a recording receiving surface. The inkjet head unit 1 is arranged in such a manner that the X direction in the drawing which is a direction along which the nozzle columns L in each head chip 20 are aligned can be set along a rotating direction of the rotary drum 30 and that each nozzle face 21 of each head chip 20 approximates the recording receiving surface of the recording medium held on the drum surface 31.

Figure 5:
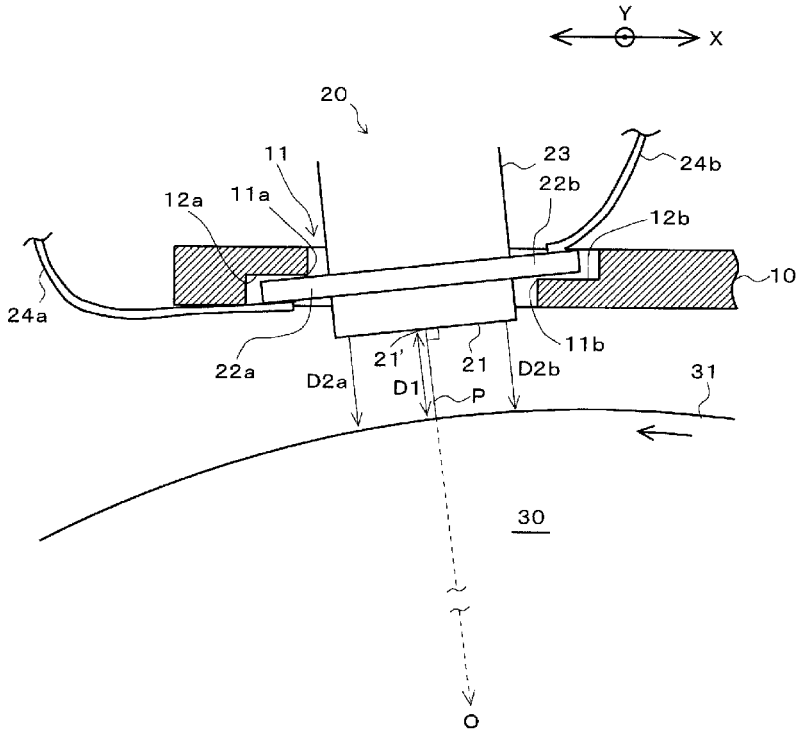
FIG. 5 is a view for explaining how the head chip is inclined.

An inclination angle of each head chip 20 relative to the surface of the head unit base 10 will now be described with reference to FIG. 5. Each head chip 20 is set so that a line P vertical to a center 21' of the nozzle face 21 can run through a rotation center O of the rotary drum 30. At this time, each head chip 20 is inclined with respect to the surface of the tabular head unit base 10 along the rotating direction of the rotary drum 30.

When the head chip 20 is inclined in this manner, the nozzle face 21 can approximate the most to the recording receiving surface of the recording medium held on the drum surface 31. At this time, a distance D1 between the center 21' of the nozzle face 21 and the recording receiving surface of the recording medium held on the drum surface 31 becomes the smallest, distances D2*a* and D2*b* between positions close to the respective attachment flange portions 22*a* and 22*b* of the nozzle face 21 and the recording receiving surface of the recording medium on the drum surface 31 become the largest, D2*a*=D2*b* is achieved, and a difference between a distance from D2*a* to D1 and a distance from D2*b* to D1 becomes the smallest. As a result, each nozzle near the center of the nozzle face 21 and nozzles at the outermost end portions on the side of the attachment flange portions 22*a* and 22*b* near the center of the nozzle 21 can suppress a deviation of an impact position caused due to a difference between the distances to the recording receiving surface of the recording medium held on the drum surface 31.

According to the present invention, to dispose each head chip 20 to be inclined with respect to the surface of the head unit base 10, a curved face or an inclined face does not have to be formed, and the configuration can be obtained by just forming the concave portions 12*a* and 12*b* so that the parallel flat faces are recessed with respect to the surface of the completely tabular head unit base 10. Therefore, a difficult operation such as bending in accordance with the drum surface 31 is not required, and the inkjet head unit 1 having the nozzle face 21 of each head chip 20 being inclined at a predetermined angle can be very easily configured.

Additionally, since the inclination angle can be adjusted by independently adjusting concave depths of the respective concave portions 12*a* and 12*b*, the nozzle face 21 of each head chip 20 can be arranged near the recording face of the recording medium held on the drum surface 31 of the rotary drum 30 as much as possible without being affected by a thickness of the head unit base 10. Therefore, the head unit base 10 can have a thickness that can assure sufficient strength.

An example of a method for manufacturing this head unit base 10 will now be described with reference to FIG. 6 to FIG. 11.

Figure 6:
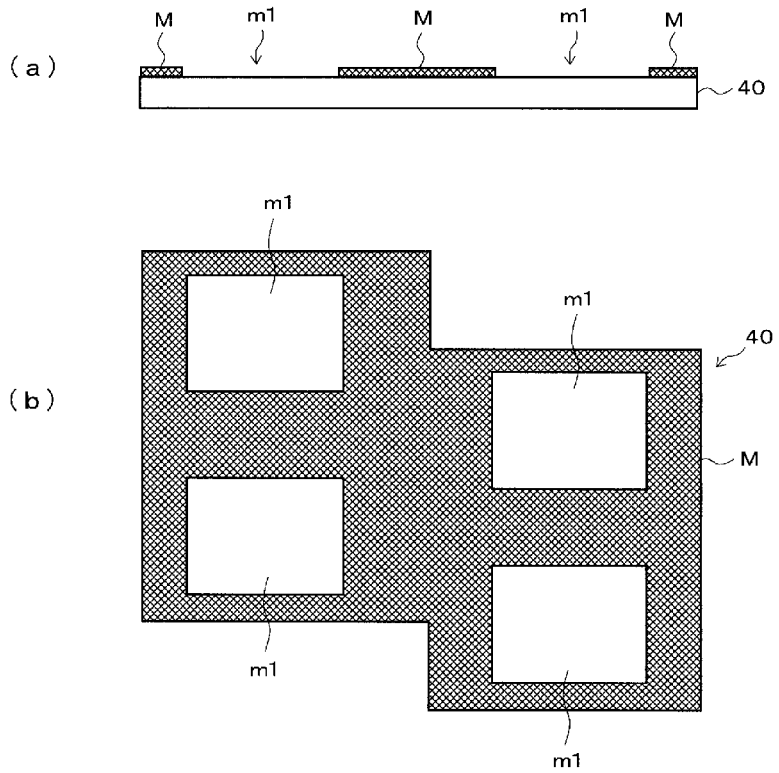
FIGS. 6*a* and 6*b* are views for explaining a method for manufacturing a head unit base.

First, each resist mask M is laminated and formed on one surface of a glass substrate 40 cut out into a predetermined planar shape, patterning is carried out based on a well-known exposure/development treatment, and the resist mask M in four rectangular regions m1, which turn to the attachment opening portions 11 arranged in a zigzag pattern, alone is removed (FIGS. 6(*a*) and (*b*)).

Figure 7:
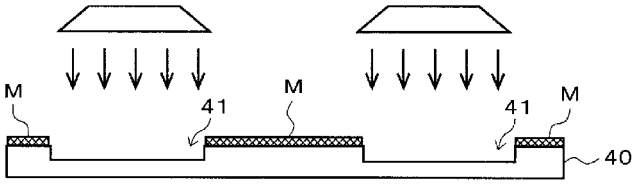
FIG. 7 is a view for explaining the method for manufacturing the head unit base.
Figure 8:
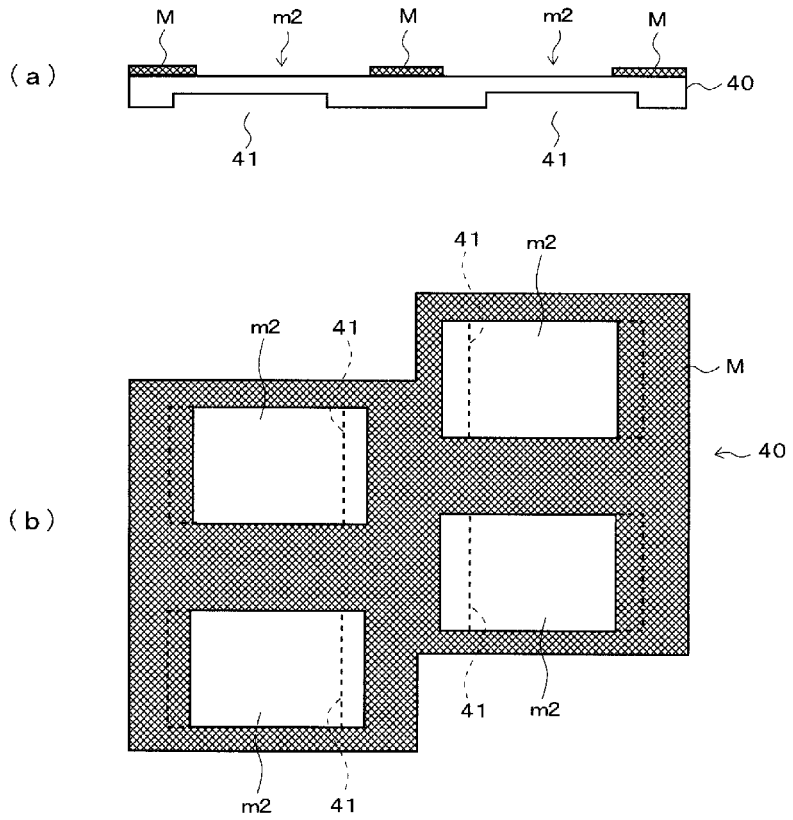
FIGS. 8*a* and 8*b* are views for explaining the method for manufacturing the head unit base.

Then, one surface of the glass substrate 40 is sandblasted. Regions covered with the resist mask M are not processed, each rectangular region m1 alone is concaved, and hence each concave portion 41 with a predetermined depth is formed. Each concave portion 41 is blasted so that its depth can be a half of a thickness of the glass substrate 40 by adjusting a processing time (FIG. 7).

Then, the resist mask M is likewise laminated and formed on the other surface of the glass substrate 40, the patterning is carried out based on the well-known exposure/development treatment, and the resist mask M in four rectangular regions m2 alone is removed. At this time, each rectangular region m2 is formed so as to be slightly biased toward the center of the glass substrate 40 with respect to a position of each concave portion 41 formed in each rectangular region m1 on the one surface (FIGS. 8(*a*) and (*b*)).

Figure 9:
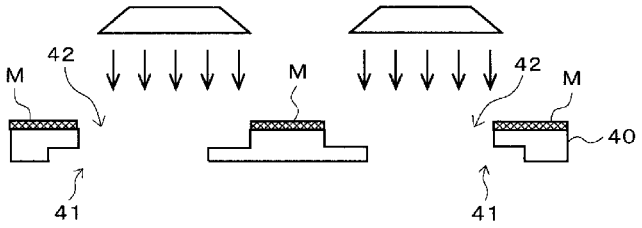
FIG. 9 is a view for explaining the method for manufacturing the head unit base.

Subsequently, the other surface of the glass substrate 40 is sandblasted. Regions covered with the resist mask M are not processed, each rectangular region m2 alone is concaved, and hence each concave portion 42 with a predetermined depth is formed. Each concave portion 42 is blasted so that its depth can be a half of the thickness of the glass substrate 40 by adjusting a processing time (FIG. 9).

Figure 10:
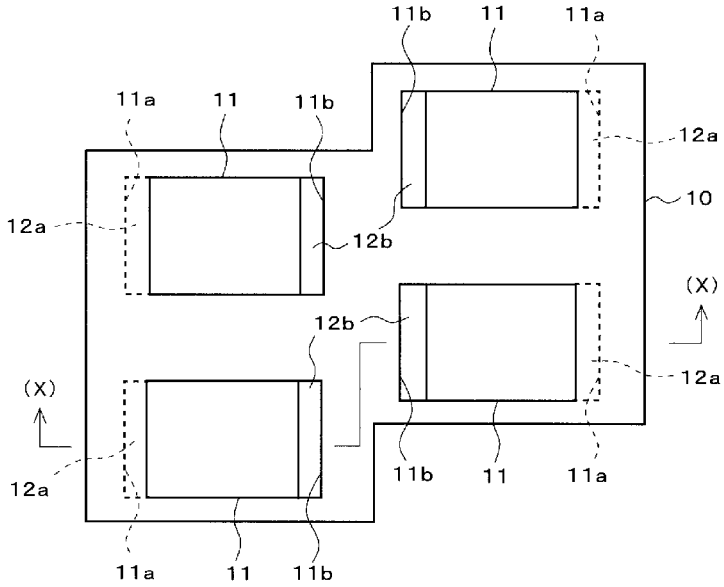
FIG. 10 is a plan view of a fabricated head unit base.
Figure 11:
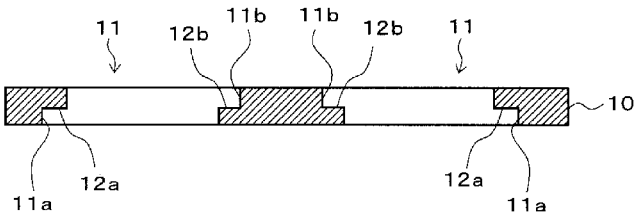
FIG. 11 is a cross-sectional view of the fabricated head unit base.

As a result, one tabular head unit base 10 having four attachment opening portions 11 is fabricated. In regard to the opposed side edge portions 11*a* and 11*b* of each attachment opening portion 11, the concave portion 12*a* is formed from the lower surface side of the head unit base 10 at one side edge portion 11*a*, whilst the concave portion 12*b* is formed from the upper surface side of the head unit base 10 at the other side edge portion 11*b*, whereby the side edge portions are formed into the stepped shapes that are staggered on the front and back sides (FIG. 10, FIG. 11).

Figure 12:
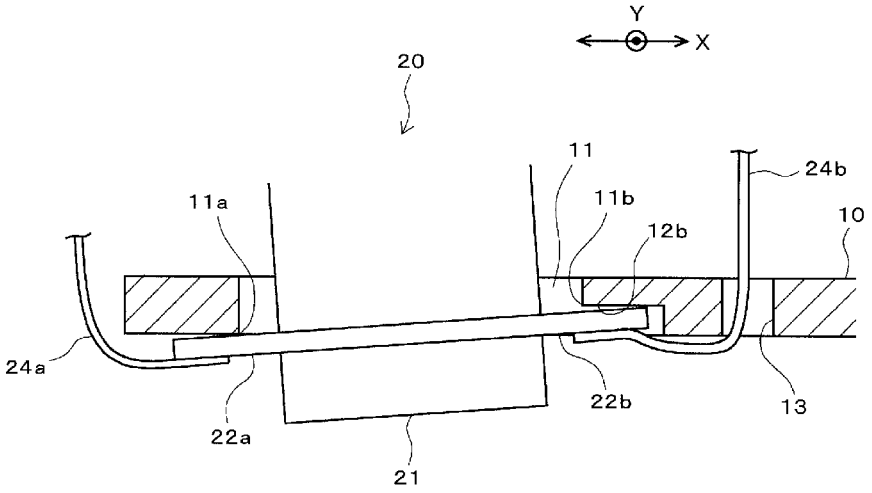
FIG. 12 is a cross-sectional view showing another conformation that the head chip is inclined with respect to the surface of the head unit base.

FIG. 12 shows another conformation that the head chip 20 is inclined with respect to the surface of the head unit base 10. Since the head chips 20 in two columns parallel to the X direction in the drawing are symmetrically provided, one head chip 20 in one column will be described here.

In this conformation, the head chip 20 is inserted into and disposed to the attachment opening portion 11 of the head unit base 10 from the lower surface side. Of the opposed side edge portions 11*a* and 11*b* of the attachment opening portion 11 on which the two attachment flange portions 22*a* and 22*b* of the head chip 20 abut, respectively, one side edge portion 11*a* is not formed into any stepped shape at all, and the other side edge portion 11*b* alone is formed into a stepped shape by forming the concave portion 12*b* from the lower surface side. Therefore, the side edge portions 11*a* and 11*b* have different height positions (height positions in the thickness direction of the head unit base 10) with respect to the lower surface of the head unit base 10.

Therefore, when the head chip 20 is disposed to this attachment opening portion 11 from the lower surface side of the head unit base 10, one attachment flange portion 22*a* abuts on the one side edge portion 11*a* of the attachment opening portion 11 from the lower surface side whilst the other attachment flange portion 22*b* abuts on the inside of the concave portion 12*b* of the other side edge portion 11*b* of the attachment opening portion 11, both the attachment flange portions 22*a* and 22*b* have different height positions relative to the lower surface of the head unit base 10, and the nozzle face 21 is disposed so as to be inclined toward the other attachment flange portion 22*b* side.

An inclination angle is finely adjusted by finely adjusting a concave depth of the concave portion 12*b* and overlapping amounts of the respective side edge portions 11*a* and 11*b* of the attachment opening portion 11 and the respective attachment flange portions 22*a* and 22*b*.

In this conformation, since the head chip 20 is disposed to the head unit base 10 from the lower surface side, the nozzle face 21 of each head chip 20 can be arranged near the recording receiving surface of the recording medium held on the drum surface 31 of the rotary drum 30 as much as possible without being affected by a thickness of the head unit base 10. Therefore, the head unit base 10 can have the thickness that can assure sufficient strength.

In this conformation, the external wiring members 24*a* and 24*b* are bonded to the lower surface sides (the nozzle face 21 sides) of the attachment flange portions 22*a* and 22*b* of the head chip 20, respectively. Although one external wiring member 24*a* placed on the outer side of the head unit base 10 can be directly drawn to the upper surface side from the lateral side of the head unit base 10, the other external wiring member 24*b* placed on the inner side of the head unit base 10 (between the columns of the head chips 20 adjacent to each other along the X direction in the drawing) cannot be drawn to the upper surface side of the head unit base 10. Therefore, a wiring extraction hole 13 that is pierced in the head unit base 10 is formed near the other side edge portion 11*b* of the attachment opening portion 11 in which the attachment flange portion 22*b* placed on the inner side of the head unit base 10 and abutting from the lower surface side of the head unit base 10 is arranged, specifically between the columns of the head chips 20 adjacent to each other along the X direction in the drawing, this wiring extraction hole 13 is utilized, and the other external wiring member 24*b* is drawn to the upper surface side of the head unit base 10 so that this member cannot be an obstacle of the head chip 20 in the adjoining column.

Figure 13:
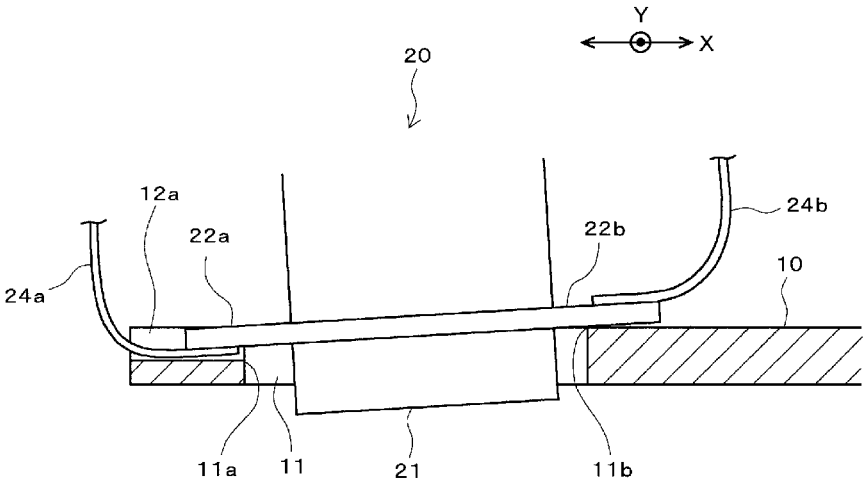
FIG. 13 is a cross-sectional view showing still another conformation that the head chip is inclined with respect to the surface of the head unit base.

FIG. 13 shows still another conformation that the head chip 20 is inclined with respect to the surface of the head unit base 10. Since the head chips 20 in two columns along the X direction in the drawing are symmetrically provided, one head chip 20 in one column will be likewise described here.

In this conformation, the head chip 20 is inserted into and disposed to the attachment opening portion 11 of the head unit base 10 from the upper surface side. Of the opposed side edge portions 11*a* and 11*b* of the attachment opening portion 11 to which the two attachment flange portions 22*a* and 22*b* of the head chip 20 abut, one side edge portion 11*a* is formed into a stepped shape by forming the concave portion 12*a* from the upper surface side, but the other side edge portion 11*b* is not formed into any stepped shape at all. Therefore, the side edge portions 11*a* and 11*b* have different height positions (height positions in the thickness direction of the head unit base 10) relative to the upper surface of the head unit base 10.

Therefore, when the head chip 20 is disposed to this attachment opening portion 11 from the upper surface side of the head unit base 10, one attachment flange portion 22*a* abuts on the inside of the concave portion 12*a* of one side edge portion 11*a* of the attachment opening portion 11 whereas the other attachment flange portion 22*b* abuts on the other side edge portion 11*b* of the attachment opening portion 11 from the upper surface side, both the attachment flange portions 22*a* and 22*b* have different height positions relative to the upper surface of the head unit base 10, and the nozzle face 21*a* is disposed so as to be inclined toward the one attachment flange portion 22*a* side.

An inclination angle is finely adjusted by finely adjusting a concave depth of the concave portion 12*a* and overlapping amounts of the respective side edge portions 11*a* and 11*b* and the respective attachment flange portions 22*a* and 22*b* of the head chip 20.

In this conformation, although each of the external wiring members 24*a* and 24*b* can be bonded to the upper surface side (the surface side opposite to the nozzle face 21) of each of the attachment flange portions 22*a* and 22*b* of the head chips 20, when the concave portion 12*a* is formed so as to be continuous with the end portion of the head unit base 10 as shown in the drawing, the external wiring member 24*a* can be directly drawn to the lateral side of the head unit base 10 from the concave portion 12*a*, and hence the attachment flange portion 22*a* side placed in this concave portion 12*a* can be bonded to the lower surface.

In this conformation, even if any bonding conformation is adopted for the external wiring members 24*a* and 24*b*, the wiring extraction hole does not have to be formed in the head unit base 10.

Figure 14:
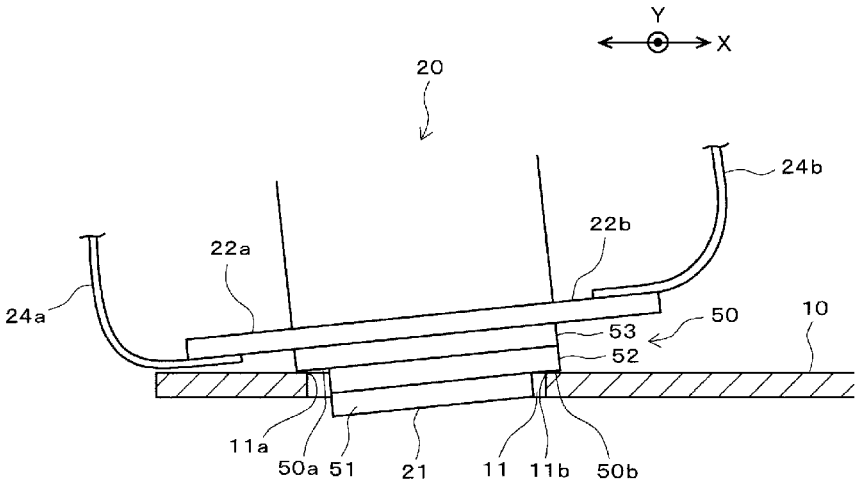
FIG. 14 is a cross-sectional view showing yet another conformation that the head chip is inclined with respect to the surface of the head unit base.

FIG. 14 shows yet another conformation that the head chip 20 is inclined with respect to the surface of the head unit base 10. Since the head chips 20 in two columns along the X direction in the drawing are symmetrically provided, one head chip 20 in one column will be likewise explained here.

In this conformation, the head chip 20 is inserted into the attachment opening portion 11 of the head unit base 10 from the upper surface side, and it is disposed by utilizing the head chip main body 50 portion of the head chip 20. The attachment opening portion 11 of the head unit base 10 is not processed at all, and the head chip main body 50 side is processed into a stepped shape.

Figure 4:
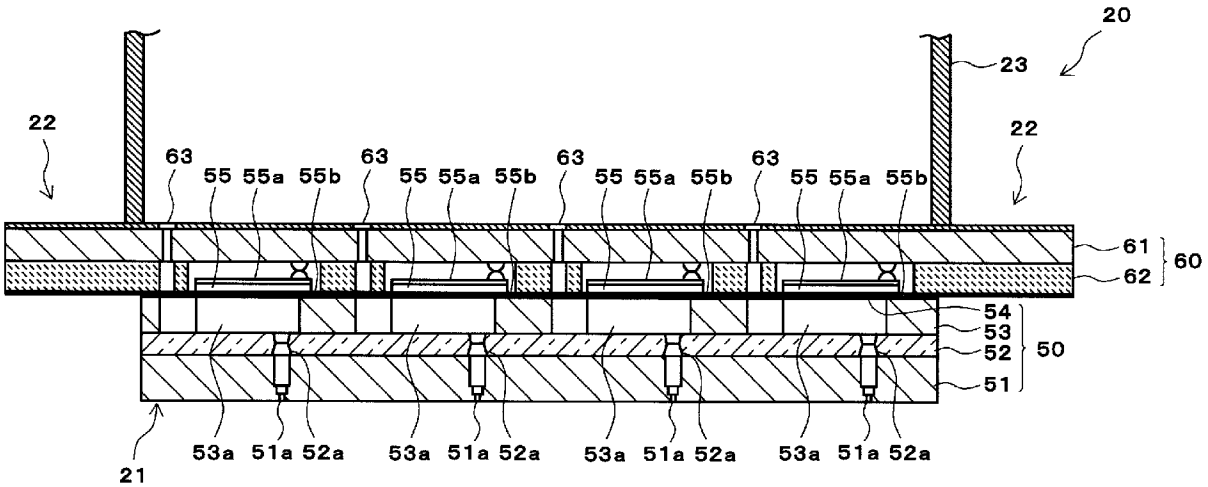
FIG. 4 is a cross-sectional view showing an internal configuration of the head chip.

Since the head chip main body 50 close to the nozzle face 21 side rather than attachment flange portions 22*a* and 22*b* in the head chip 20 is formed of a plurality of layers (the nozzle plate layer 51, the intermediate plate layer 52, the pressure chamber plate layer 53, the vibrating plate 54) as shown in FIG. 4, the plurality of layers have different widths (lengths along the X direction in the drawing) so that the lower surface side (the nozzle face side) of each different layer in the plurality of layers can abut on the opposed side edge portions 11*a* and 11*b* of the attachment opening portion 11. It is to be noted that the vibrating plate 54 is omitted in FIG. 14.

Here, in the head chip main body 50, each of the nozzle plate layer 51 and the intermediate plate layer 52 in a region associated with one side edge portion 11*a* of the attachment opening portion 11 is formed with a narrower width than those of the pressure chamber plate layer 53 and the vibrating plate 54 which are the upper layers, the lower surface side of the pressure chamber plate layer 53 is thereby exposed, an abutting step portion 50*a* with a stepped shape that functions as an abutting face on the side edge portion 11*a* of the attachment opening portion 11 is formed. Further, in a region associated with the other side edge portion 11*b* of the attachment opening 11, the nozzle plate layer 51 alone is formed with a narrower width than those of the intermediate plate layer 52, the pressure chamber plate layer 53, and the vibrating plate 54 which are the upper layers, the lower surface side of the intermediate plate layer 52 is exposed, and an abutting step portion 50*b* with the stepped shape that functions as an abutting face on the side edge portion 11*b* of the attachment opening portion 11 is formed. These abutting step portions 50*a* and 50*b* have different height positions on the lower surface side, and the abutting step portion 50*b* has the height position closer to the nozzle face 21 as compared with the abutting step portion 50*a*.

Therefore, when this head chip 20 is disposed from the upper surface side of the head unit base 10, the abutting step portion 50*a* farther from the nozzle face 21 abuts on the one side edge portion 11*a* of the attachment opening portion 11 on the lower surface of the pressure chamber plate layer 53 from the upper surface side, whereas the abutting step portion 50*b* closer to the nozzle face 21 abuts on the other side edge portion 11*b* on the lower surface of the intermediate plate layer 52 from the upper surface side. As a result, the nozzle face 21 is disposed so as to be inclined toward one attachment flange portion 22*a* side so that the abutting step portion 50*a* side protrudes to the lower side of the head unit base 10 as compared with the abutting step portion 50*b* side.

An inclination angle is finely adjusted by finely adjusting thicknesses of the respective layers and overlapping amounts of the respective side edge portions 11*a* and 11*b* of the attachment opening portion 11 and the abutting step portions 50*a* and 50*b*.

According to this conformation, forming the attachment opening portion 11 on the head unit base 10 side can suffice, and processing for forming the stepped shape is not required. At the time of laminating and forming the head chip main body 50 of the head chip 20, when some of the layers have different widths, the surfaces abutting on the side edge portions 11*a* and 11*b* of the attachment opening portion 11 can be formed into the stepped shapes, and hence a manufacturing process can be simplified.

In this conformation, although each of the external wiring members 24*a* and 24*b* can be bonded to the upper surface side (the opposite surface side of the nozzle face 21) of each of the attachment flange portions 22*a* and 22*b* of the head chip 20, both the attachment flange portions 22*a* and 22*b* are exposed to the upper surface side of the head unit base 10, and hence each of the external wiring members 24*a* and 24*b* can be bonded to the lower surface side of each of the attachment flange portions 22*a* and 22*b*. Therefore, a wiring extraction hole does not have to be formed in the head unit base 10.

Moreover, in this conformation, the head chip is formed of the plurality of layers, the plurality of layers have the different widths so that the respective different layers abut on the opposed side edge portions of the attachment opening portion, the abutting faces relative to the side edge portions are thereby formed, and hence the attachment flange portions 22*a* and 22*b* do not have to be provided.

Figure 15:
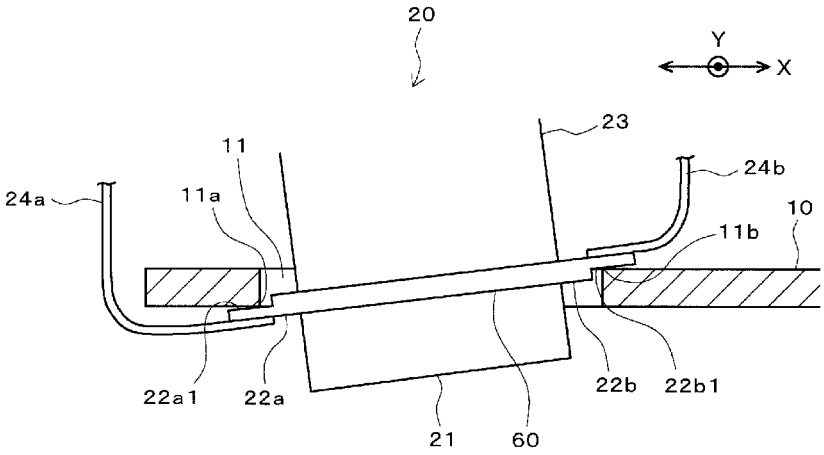
FIG. 15 is a cross-sectional view showing a further conformation that the head chip is inclined with respect to the surface of the head unit base.

FIG. 15 shows a further conformation that the head chip 20 is inclined with respect to the surface of the head unit base 10. Since the head chips 20 in two columns along the X direction in the drawing are symmetrically provided, one head chip in one column will be likewise explained here.

In this conformation, the attachment opening portion 11 of the head unit base 10 is not processed at all like FIG. 14. In this conformation, the wiring substrate layer 60 constituting the attachment flange portions 22*a* and 22*b* of the head chip 20 is processed into a stepped shape.

Here, an end portion of the attachment flange portion 22*a*, which is associated with one side edge portion 11*a* of the attachment opening portion 11, in the wiring substrate layer 60 is formed into a stepped shape that is concaved from the upper surface side. As a result, an abutting step portion 22*a*1 having a partially reduced thickness is formed at the end portion of the attachment flange portion 22*a*. This abutting step portion 22*a*1 can be formed by partially reducing a thickness of the substrate main body 61 of the wiring substrate layer 60.

Further, an end portion of the attachment flange portion 22*b*, which is associated with the other side edge portion 11*b* of the attachment opening portion 11, in the wiring substrate layer 60 is formed into a stepped shape that is concaved from the lower surface side. As a result, an abutting step portion 22*b*1 having a partially reduced thickness is formed at the end portion of the attachment flange portion 22*b*. This abutting step portion 22*b*1 can be formed by partially reducing the adhesive resin layer 62 of the wiring substrate layer 60.

This head chip 20 is disposed to the head unit base 10 in such a manner that the abutting step portion 22*a*1 formed on the upper surface side abuts on one side edge portion 11*a* of the attachment opening portion 11 in the one attachment flange portion 22*a* and the abutting step portion 22*b*1 formed on the lower surface side abuts on the other side edge portion 11*b* of the attachment opening portion 11 in the other attachment flange portion 22*b*. As a result, the nozzle face 21 is inclined and disposed so that the attachment flange portion

22*a* can protrude on the lower side of the head unit base 10 as compared with the attachment flange portion 22*b* side.

An inclination angle is finely adjusted by finely adjusting concave thicknesses of the respective abutting step portions 22*a*1 and 22*b*1 relative to the wiring substrate layer 60 and overlapping amounts of the respective side edge portions 11*a* and 11*b* of the attachment opening portion 11 and the abutting step portions 22*a*1 and 22*b*1.

According to this conformation, forming the attachment opening portion 11 alone on the head unit base 10 side can suffice, and the processing for forming the stepped shape is not required. At the time of forming the wiring substrate layer 60 of the head chip 20, when the end portions, which turn to the attachment flange portions 22*a* and 22*b*, are concaved from the upper surface side or the lower surface side and the thicknesses of the end portions are reduced, each of the faces abutting on the side edge portions 11*a* and 11*b* of the attachment opening portion 11 can be formed into the stepped shape. Furthermore, processing the wiring substrate layer 60 alone can suffice, and the head chip main body 50 does not have to be processed as different from the conformation shown in FIG. 14, and hence the manufacturing process can be further simplified.

FIG. 15 shows an example that the respective abutting step portions 22*a*1 and 22*b*1 are formed on the attachment flange portions 22*a* and 22*b*. However, the abutting step portion may be formed at any one of the two attachment end portions 22*a* and 22*b*.

Figure 16:
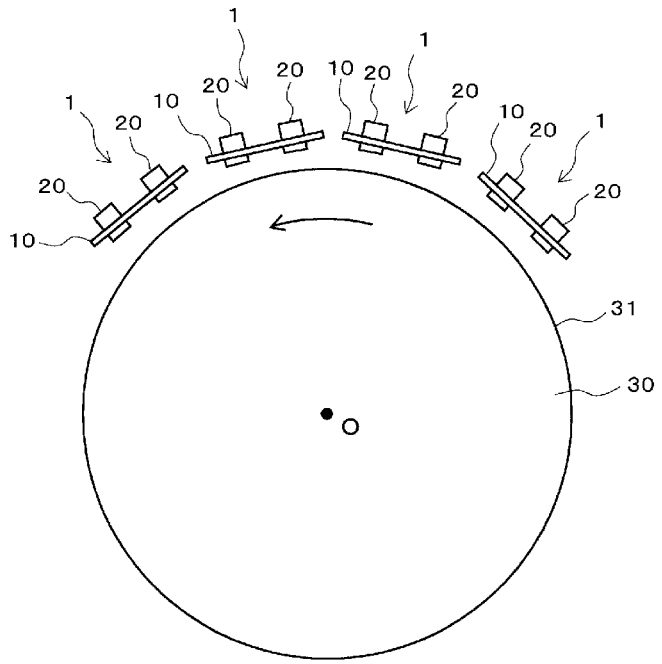
FIG. 16 is a schematic view showing an example of an inkjet recording device according to the present invention.
Figure 17:
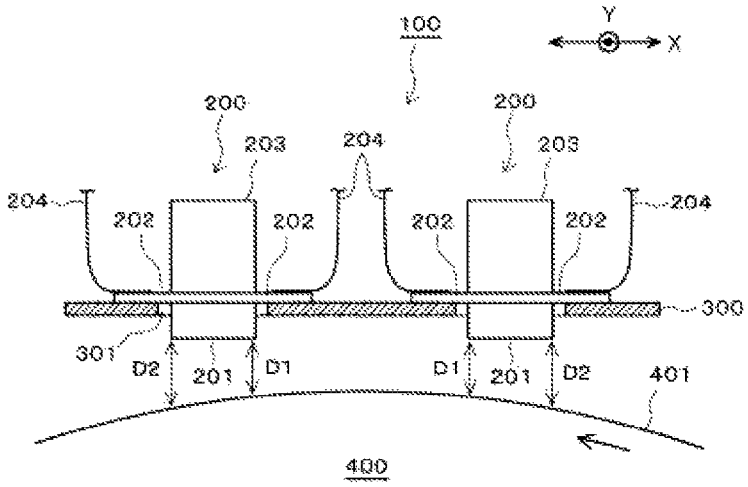
FIGS. 17*a* and 17*b* are views for explaining a conventional inkjet head unit.
Figure 17:
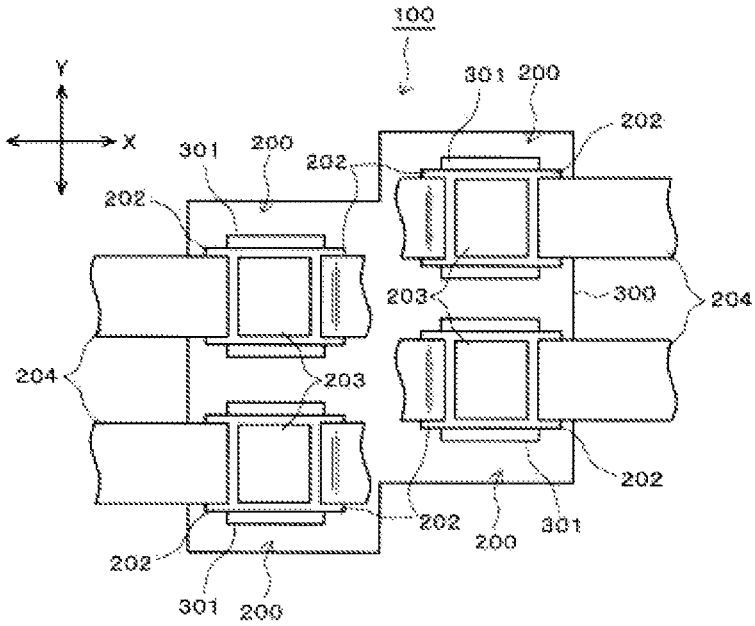
Figure 18:
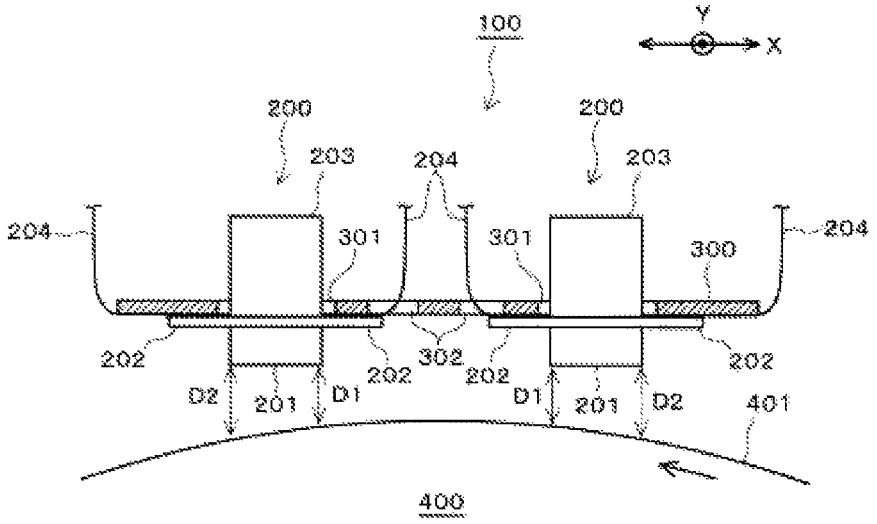
FIG. 18 Prior Art
FIG. 18 is a view for explaining another conformation of the conventional inkjet head unit.
Figure 19:
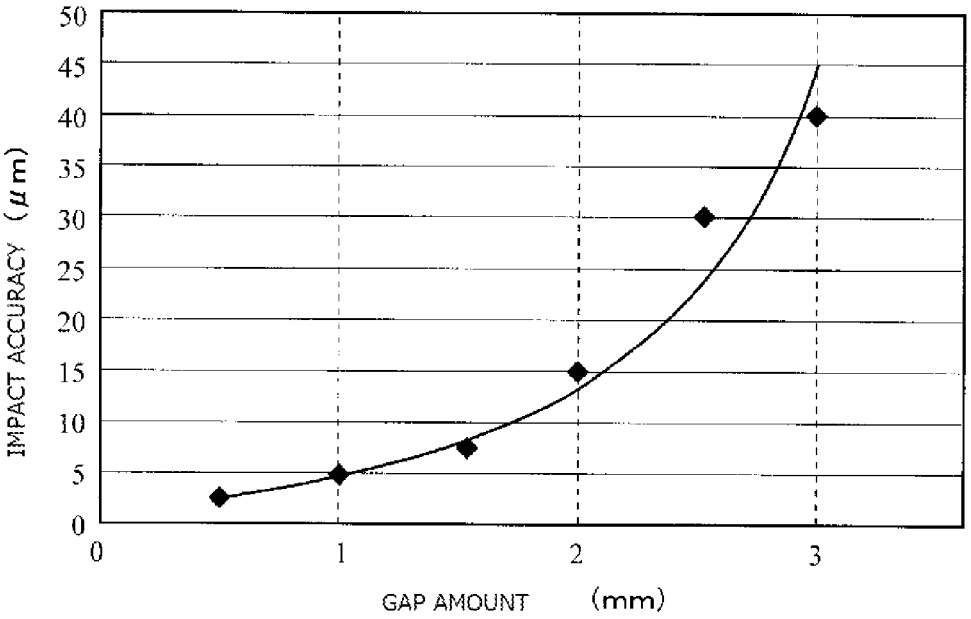
FIG. 19 is a graph showing a relationship between a gap amount and an impact accuracy.

FIG. 16 shows an example of an inkjet recording device according to the present invention. The inkjet recording device is constituted by arranging the plurality of inkjet head units 1 near a recording receiving surface of a recording medium (not shown) held on the drum surface 31 of one rotary drum 30 along a rotating direction of this drum. Each head chip 20 of each inkjet head unit 1 is arranged to be inclined with respect to the surface of each head unit base 10 in such a manner that, for example, the X direction in FIG. 1 is set along the rotating direction of the rotary drum 30 and the perpendicular for the center 21' of each of all the nozzle faces 21 can coincide with the rotation center O of the rotary drum 30 as described in conjunction with FIG. 5.

According to such an inkjet recording device, even though each head chip 20 in each inkjet head unit 1 has a simple configuration, it is disposed to be inclined to the curved recording receiving surface of the recording medium held on the curved drum surface 31, and hence a deviation of an impact position caused by each nozzle position can be suppressed, thus enabling recording with high image quality.

The invention claimed is:

1. An inkjet head unit comprising:

a plurality of head chips, each of the plurality of head chips comprising:

a nozzle face;

a plurality of nozzles arranged on the nozzle face; and a plurality of pressure chambers in communication with the plurality of nozzles;

wherein each of the plurality of head chips is structured to discharge an ink from the plurality of pressure chambers; and a tabular head unit base on which the plurality of head chips are disposed, wherein, of abutting faces on which the head unit base and each of the plurality of head chips abut, at least any one of the abutting face on the head unit base side corresponding to each of the plurality of head chips is formed into a stepped shape, a height of the abutting face of each of the plurality of head chips relative to a surface of the head unit base is partially changed, and hence each of the plurality of head chips is disposed to be inclined to the surface of the head unit base.

2. The inkjet head unit according to claim 1, wherein the head unit base has an attachment opening portion for each of the plurality of head chips, and each of the plurality of head chips has attachment flange portions that protrude to opposed lateral sides and are disposed to the head unit base when the respective attachment flange portions abut on opposed side edge portions of the attachment opening portion, the side edge portions are formed into a stepped shape, and a height of the abutting face of each of the plurality of head chips relative to the surface of the head unit is partially changed.

3. The inkjet head unit according to claim 2, wherein any one of the side edge portions of the attachment opening portion in the head unit base is concaved into a stepped shape with a predetermined depth from an surface side of the head unit base opposite to an ink discharging direction, and the head chip is disposed to be inclined relative to the surface of the head unit base when the respective attachment flange portions abut on the head unit base from the surface side of the head unit base opposite to the ink discharging direction and one attachment flange portion abuts on the side edge portion concaved into the stepped shape.

4. The inkjet head unit according to claim 2, wherein any one of the side edge portions of the attachment opening portion in the head unit base is concaved into a stepped shape with a predetermined depth from an surface side of the head unit base in an ink discharging direction, and the head chip is disposed to be inclined relative to the surface of the head unit base when the respective attachment flange portions abut on the head unit base from the surface side of the head unit base in the ink discharging direction and one attachment flange portion abuts on the side edge portion concaved into the stepped shape.

5. The inkjet head unit according to claim 4, wherein an external wiring member is connected to each of the attachment flange portions of the head chip, and a wiring extraction hole is pierced and formed near the side edge portion concaved from the surface side of the head unit base in the ink discharging direction, and the external wiring member connected to the attachment flange portion abutting on the side edge portion is drawn to the surface of the head unit base opposite to the ink discharging direction through the wiring extraction hole.

6. The inkjet head unit according to claim 3, wherein a material of the head unit base is glass, and the head unit base is concaved into the stepped shape with a predetermined depth by blasting.

7. The inkjet head unit according to claim 3, wherein a material of the head unit base is Si, and the head unit base is concaved into the stepped shape with a predetermined depth by etching.

8. The inkjet head unit according to claim 3, wherein a material of the head unit base is SUS, and the head unit base is concaved into the stepped shape with a predetermined depth by at least one of milling, blasting, and etching.

9. The inkjet head unit according to claim 3, wherein the head unit base has an attachment opening portion for each of the plurality of head chips; and each of the plurality of head chips have attachment flange portions that protrude to opposed lateral sides and are disposed to the heat unit base when the respective attachment flange portions abut on opposed side edge portions of the attachment opening portion, the attachment flange portions are formed into a stepped shape, and a height of the abutting face of each of the plurality of head chips relative to the surface of the head unit base is partially changed.

10. The inkjet head unit according to claim 1, wherein the head unit has an attachment opening portion for the head chip, and the head chip is formed of a plurality of layers, the plurality of layers have different widths so that different layers in the plurality of layers abut on opposed side edge portions of the attachment opening portion, and abutting faces relative to the side edge portions are thereby formed.

11. The inkjet head unit according to claim 1, wherein the head chip is bonded to the head unit base by a photosensitive adhesive.

12. The inkjet head unit according to claim 1, wherein the head chip comprises a plurality of nozzle columns that are aligned along an inclining direction of the head chip.

13. An inkjet recording device comprising:

a rotary drum which is rotatable while holding a recording medium on a curved surface thereof; and an inkjet head unit according to claim 1 which has the plurality of head chips arranged along a circumferential direction of the rotary drum, is arranged in such a manner that the respective nozzle faces of the head chips are placed near a recording receiving surface of the recording medium held on the surface of the rotary drum, and performs drawing by discharging an ink from the nozzles toward the recording receiving surface of the recording medium, wherein a line of each of the plurality of head chips, which are arranged in the circumferential direction of the rotary drum, vertical to the center of each nozzle face runs through a rotation center of the rotary drum.

14. An inkjet head unit comprising:

a plurality of head chips, each of the plurality of head chips comprising:

a nozzle face;

a plurality of nozzles arranged on the nozzle face; and a plurality of pressure chambers in communication with the plurality of nozzles;

wherein each of the plurality of head chips is structured to discharge an ink from the plurality of pressure chambers; and a tabular head unit base on which the plurality of head chips are disposed, wherein, of abutting faces on which the head unit base and each of the plurality of head chips abut, at least any one of the abutting face on the head unit base side corresponding to each of the plurality of head chips is formed into a stepped shape, a height of the abutting face of each of the plurality of head chips relative to a surface of the head unit base is partially changed, and hence each of the plurality of head chips is disposed to be inclined to the surface of the head unit base;

the head unit base has an attachment opening portion for each of the plurality of head chips, each of the plurality of head chips has attachment flange portions that protrude to opposed lateral sides and are disposed to the head unit base when the respective attachment flange portions abut on opposed side edge portions of the attachment opening portion, the side edge portions are formed into a stepped shape, and a height of the abutting face of each of the plurality of head chips relative to the surface of the head unit is partially changed;

any one of the side edge portions of the attachment opening portion in the head unit base is concaved into a stepped shape with a predetermined depth from an surface side of the head unit base in an ink discharging direction, and the other side edge portion is concaved into a stepped shape with a predetermined depth from the surface side of the head unit base opposite to the ink discharging direction, and the head chip is disposed to be inclined relative to the surface of the head unit base when one attachment flange portion abuts on the head unit base from the surface side of the head unit base in the ink discharging direction and also abuts on the side edge portion concaved into the stepped shape with the predetermined depth from the surface side of the head unit base in the ink discharging direction and the other attachment flange portion abuts on the head unit base from the surface side of the head unit base opposite to the ink discharging direction and also abuts on the side edge portion concaved into the stepped shape with the predetermined depth from the surface side of the head unit base opposite to the ink discharging direction.

15. An inkjet head unit comprising:

a plurality of head chips, each of the plurality of head chips comprising:

a nozzle face;

a plurality of nozzles arranged on the nozzle face; and a plurality of pressure chambers in communication with the plurality of nozzles;

wherein each of the plurality of head chips is structured to discharge an ink from the plurality of pressure chambers; and a tabular head unit base on which the plurality of head chips are disposed, wherein, of abutting faces on which the head unit base and each of the plurality of head chips abut, the abutting face on the head chip side provided corresponding to the head unit base is formed into a stepped shape, a height of the abutting face of each of the plurality of head chips relative to a surface of the head unit base is partially changed, and each of the plurality of head chips is disposed to be inclined to the surface of the head unit base.

* * * * *